US007108514B2

(12) United States Patent
Chen et al.

(10) Patent No.: US 7,108,514 B2
(45) Date of Patent: Sep. 19, 2006

(54) POWER CONNECTOR

(75) Inventors: Zhi-Qiang Chen, Kunsan (CN); Ning Wang, Kunsan (CN)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 11/026,636

(22) Filed: Dec. 30, 2004

(65) Prior Publication Data

US 2005/0233603 A1 Oct. 20, 2005

(30) Foreign Application Priority Data

Apr. 20, 2004 (CN) ..... 2004 2 0026547

(51) Int. Cl.
*H01R 12/00* (2006.01)

(52) U.S. Cl. ..... 439/63; 439/675

(58) Field of Classification Search ..... 439/63, 439/668, 675, 607, 581
See application file for complete search history.

(56) References Cited

U.S. PATENT DOCUMENTS 4,360,244 A * 11/1982 Forney et al. ..... 439/581
5,062,811 A * 11/1991 Hackman ..... 439/620
5,927,999 A 7/1999 Shimojyo
6,322,397 B1 11/2001 Zhang
6,932,614 B1 * 8/2005 Kan ..... 439/580

* cited by examiner

*Primary Examiner*—Tho D. Ta
*Assistant Examiner*—Vanessa Girardi
(74) *Attorney, Agent, or Firm*—Wei Te Chung

(57) ABSTRACT

A power connector includes a housing (10) defining a tube-like receiving chamber (16) extending through a front face (11) thereof and a receiving hole extending through a rear face (12) thereof, a first contact (20) extending into the receiving chamber, and a second contact (50) extending into the receiving hole. The receiving hole comprises a front section (17) and a rear section (18). The front section is communicating with the receiving chamber and is larger than the rear section in diameter thereof to form a step portion therebetween. The second contact (50) is a single piece and comprises an engaging portion (51) extending in the receiving chamber, a retaining portion (52) extending from the engaging portion and engaging with the step portion for preventing the second contact from moving rearwardly, and a connecting portion (53) extending from the retaining portion and comprising a bent portion engaging with the rear face of the housing for preventing the second contact from moving forwards.

15 Claims, 6 Drawing Sheets

POWER CONNECTOR

BACKGROUND OF THE INVENTION

1. Field of the Invention

The present invention relates to a power connector.

2. Description of Related Art

Power connectors which have a central contact and peripheral resilient contacts are widely used in the field of electronics. The central contact and the peripheral resilient contacts respectively act as a positive pole and a negative pole of a power supply for providing voltage to electrical components connecting to the power connector. For transmitting voltage steadily, it's needed to ensure a certain pressing force between the central contact and the terminal of the complementary connector while the power connector engaging with the complementary connector. Because of the pressing force, a pushing/pulling force between the central contact and the terminal of the complementary connector arises when the complementary connector is inserted or drawn out, and the pushing/pulling force will affect the secure retention of the central contact in the housing of the power connector.

U.S. Pat. No. 6,322,397 discloses a central contact which is secured within the housing of the power connector by fixing it onto a projection thereby. However, in such case, when the complementary connector is inserted into the power connector, the pushing force will make the central contact be pushed backward away from the housing, then cause the unreliable engagement between the central contact and the terminal of the complementary connector leading unsteadily transmitting of the voltage.

U.S. Pat. No. 5,927,999 discloses a conductive pin fixed within the housing together with a flake-like terminal, and the flake-like terminal is crimped onto the conductive pin to prevent the conductive pin from coming off. However, such a way transmitting the voltage by transferring it from another terminal to the conductive pin increases the resistance. And it's possible to cause an open circuit once if the engagement between the conductive pin and flake-like terminal failed.

There is also such a power connector that comprises a housing, a central contact and a locking plate. The housing having a opening on its top surface, the central contact having a annular groove, and the locking plate is inserted into the opening of the housing for engaging with the annular groove of the central contact to secure the central connector within the housing, ensuring the central contact is prevented from pushing/pulling away while the complementary connector is inserted into or drawn out of the housing. However, such a securing method increases an additional component, also complicates the assemble process.

Hence, an improved power connector is required to overcome the disadvantages of the prior art.

SUMMARY OF THE INVENTION

An object of the present invention is to provide a power connector in which conductive contact is fastened thereby firmly and securely.

A second object of the present invention is to provide a power connector of a simple design.

Accordingly, to achieve above-mentioned objects, a power connector of present invention includes a housing defining a tube-like receiving chamber extending through a front face thereof and a receiving hole extending through a rear face thereof, a first contact extending into the receiving chamber, and a second contact extending into the receiving hole. The receiving hole comprises a front section and a rear section. The front section is communicating with the receiving chamber and is larger than the rear section in diameter thereof to form a step portion therebetween. The second contact is a single piece and comprises an engaging portion extending in the receiving chamber, a retaining portion extending from the engaging portion and engaging with the step portion for preventing the second contact from moving rearwardly, and a connecting portion extending from the retaining portion and comprising a bent portion engaging with the rear face of the housing for preventing the second contact from moving forwards.

Other objects, advantages and novel features of the present invention will become more apparent from the following detailed description of the present embodiment when taken in conjunction with the accompanying drawings.

DETAILED DESCRIPTION OF THE INVENTION

Figure 1:
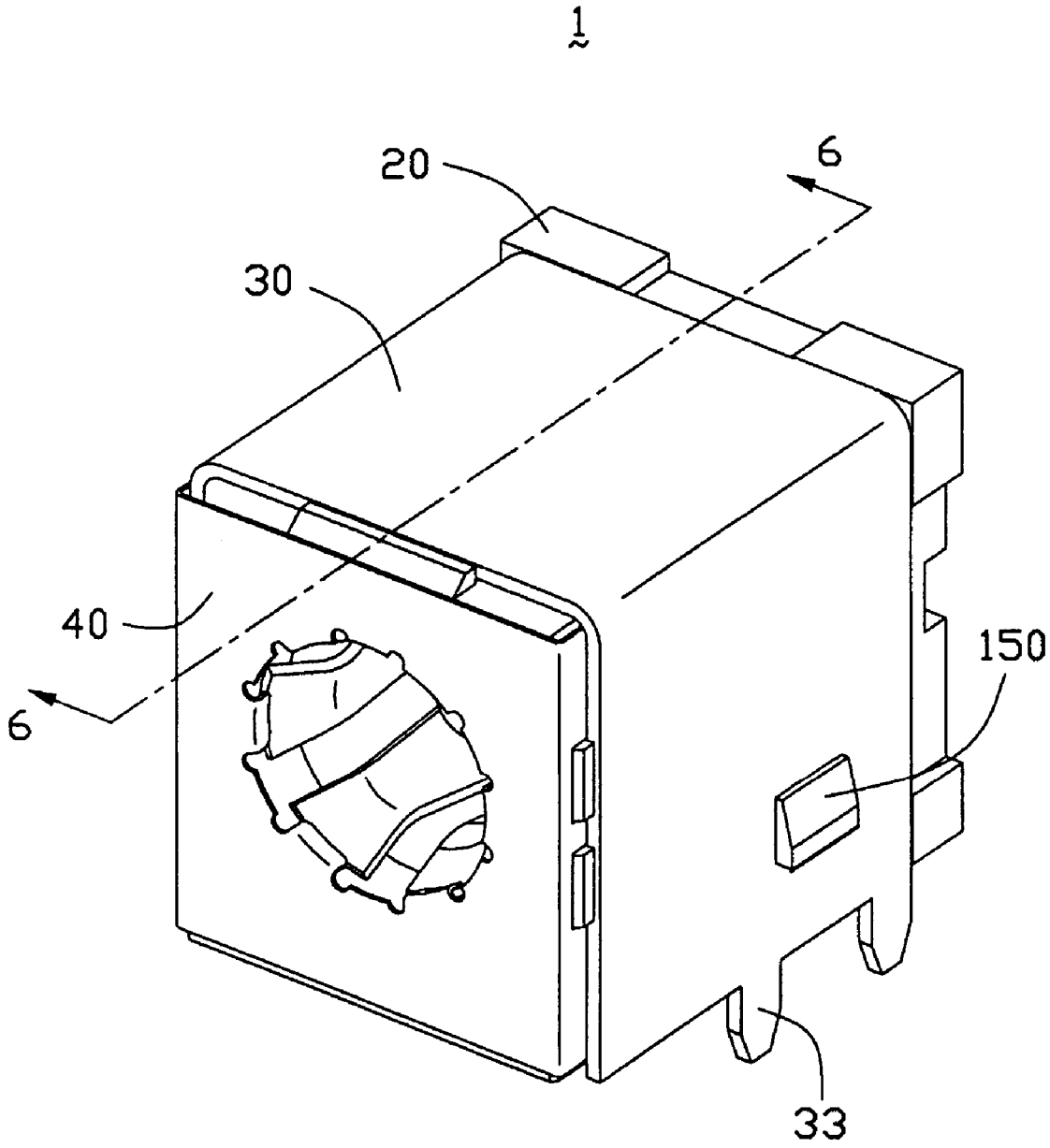
FIG. 1 is an assembled perspective view of a power connector of the present invention.
Figure 2:
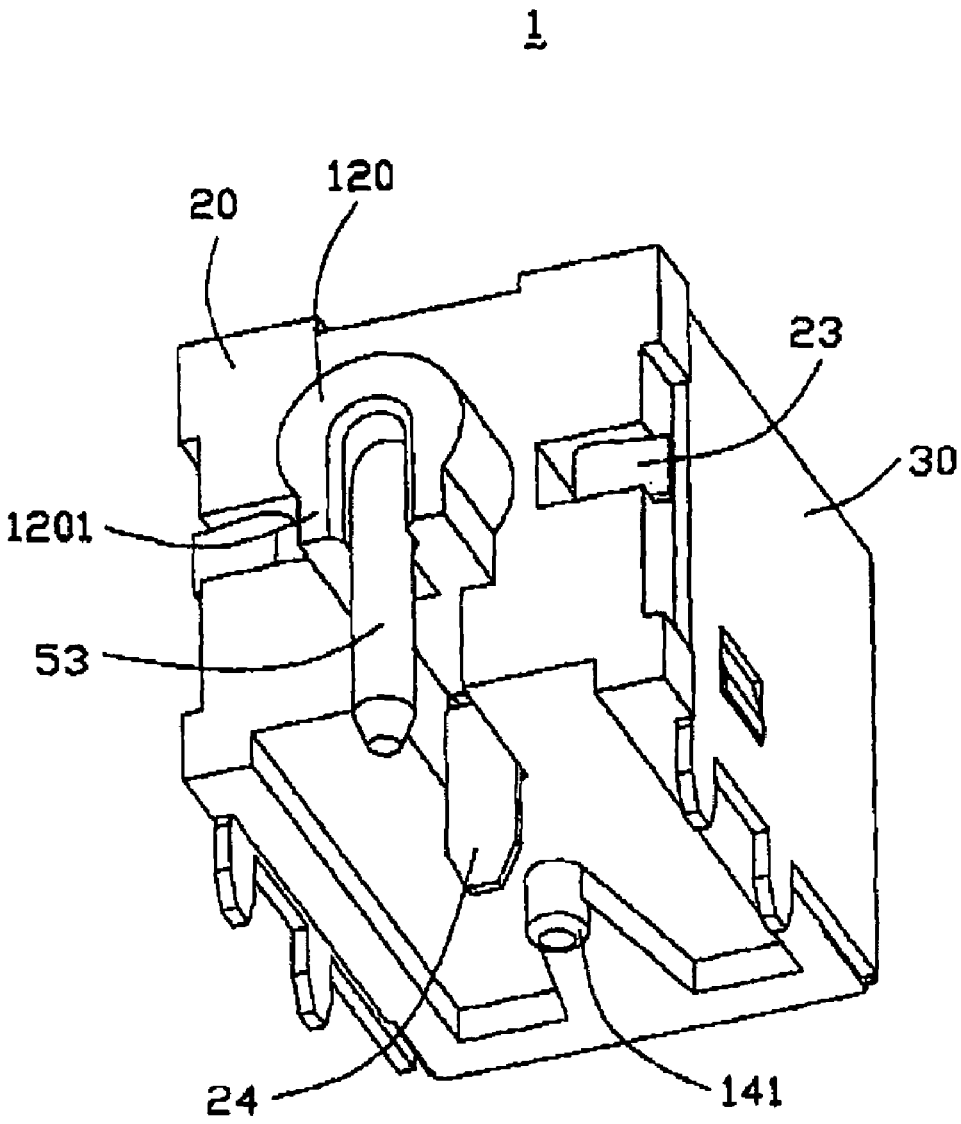
FIG. 2 is an assembled perspective view of the power connector of FIG. 1 but taken from another aspect.

Referring to FIGS. 1 to 4, a power connector 1 of the present invention comprises an insulative housing 10, a first contact 20, a rear shield 30, a front shield 40 and a second contact 50.

Figure 3:
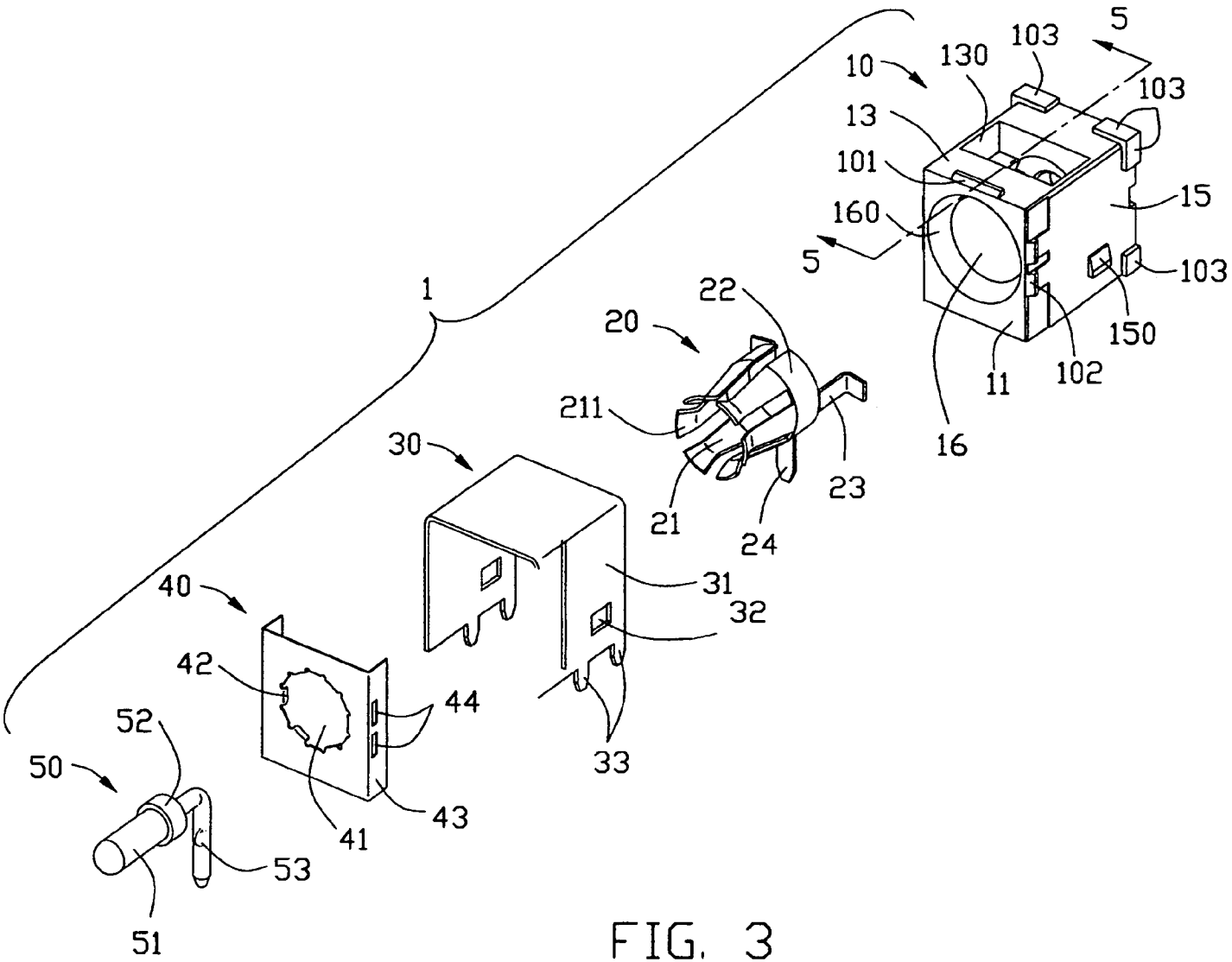
FIG. 3 is an exploded view of the power connector of FIG. 1.

Further referring to FIG. 3, the housing 10 approximately in the shape of a cubical block has a front face 11, a rear face 12, a top face 13, a bottom face 14 and two side faces 15. A tube-like receiving chamber 16 is defined within the housing 10 extending through the front face 11 thereof. The receiving chamber 16 comprises a guiding portion 160 having an inwardly decreasing diameter and a cylindrical inner portion 161 (referring to FIG. 5). An opening 130 is defined on the center of the top face 13, downwardly communicating with the cylindrical inner portion 161 of the receiving chamber 16, functioning as radiator for dispelling the heat during the voltage transmitting.

The housing 10 has a protruding ridge 101 formed on a fringe of the top face 13 adjacent the front face 11, and protruding ridge couples 102 formed on fringes of the side faces 15 adjacent the front face 11. The housing 10 also has protruding portions 103 formed at corners on the top face 13 and the side faces 15 adjacent the rear face 12. Additionally, a pair of protuberances 150 is symmetrically formed on the side faces 15 of the housing 10.

The protruding ridge 101, the protruding ridge couples 102, the protruding portions 103 all have the same thickness with the rear shield 30, while an interval between the protruding ridge 101 (or the protruding ridge couples 102) and the protruding portions 103 are equal to a width of the rear shield 30, for receiving the rear shield 30 suitably.

Figure 4:
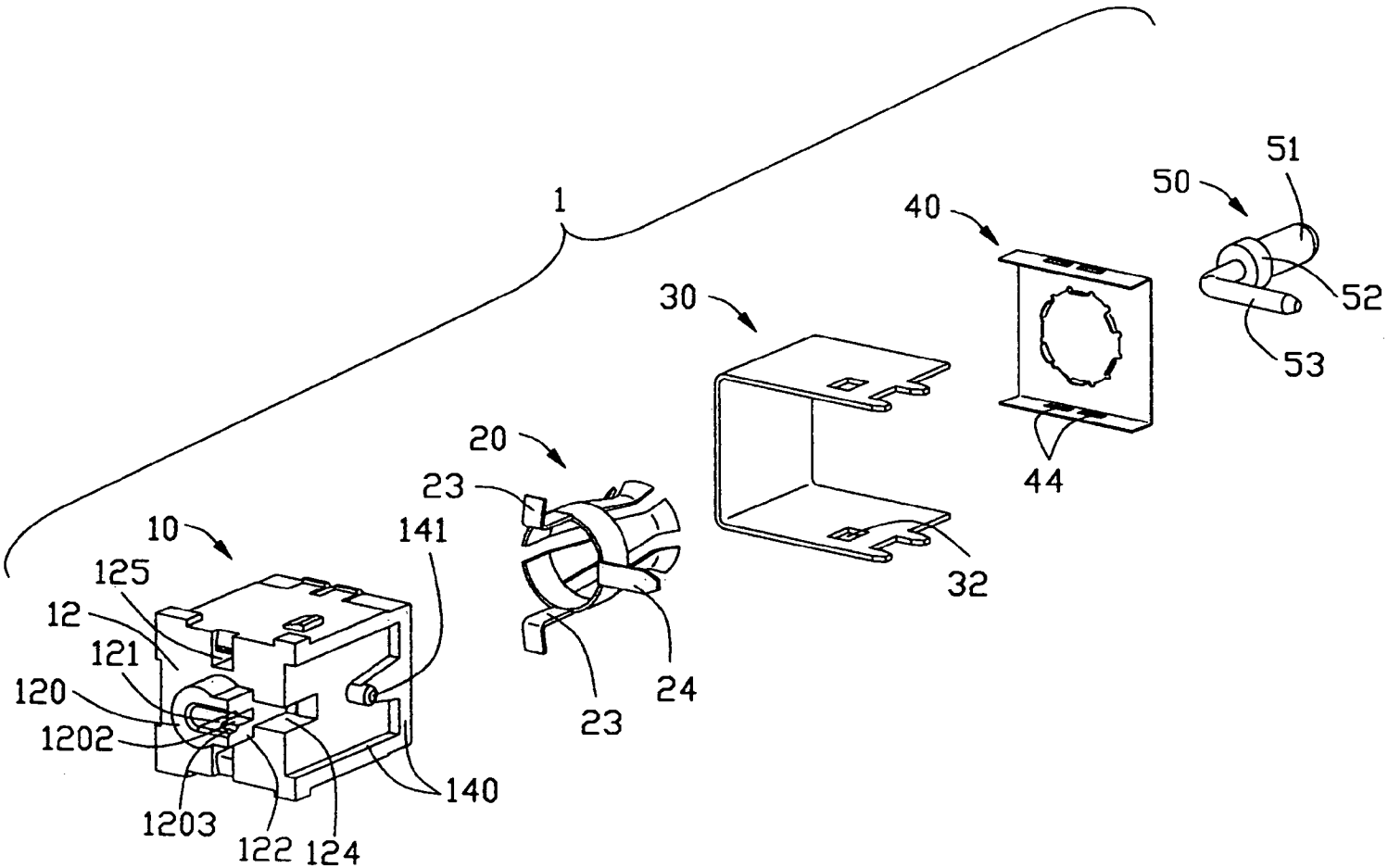
FIG. 4 is an exploded view of the power connector of FIG. 2.
Figure 5:
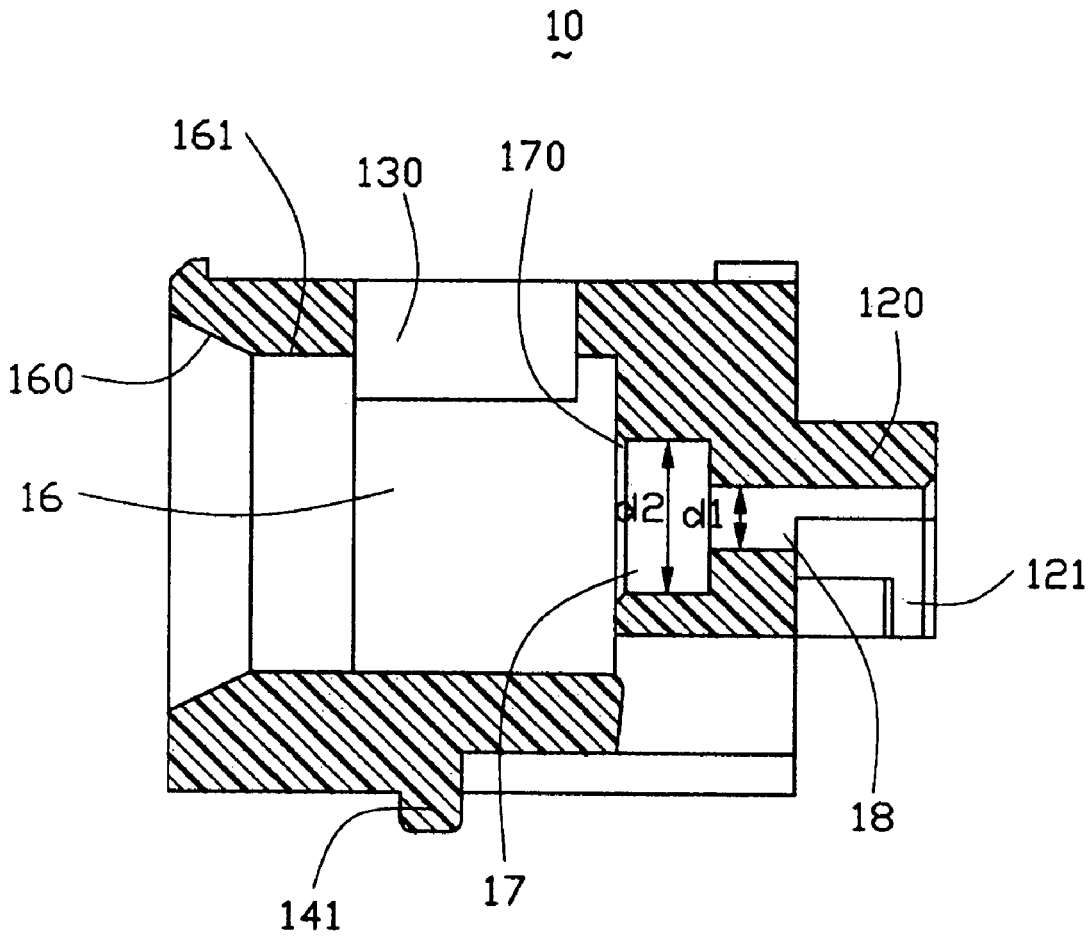
FIG. 5 is a cross-sectional view of the power connector taken along line 5—5 of FIG. 3.

Referring to FIG. 4, the housing 10 has a projection 120 projecting from the center of the rear face 12. Referring to FIG. 5 together, a receiving hole (not labeled) extending throughout the projection 120 and comprising a front section 17 and a rear section 18 is defined within the housing 10, and the front section 17 communicates with the receiving chamber 16. A diameter ($d_2$) of the front section 17 is larger than a diameter ($d_1$) of the rear section 18, forming a step portion (not labeled) therebetween. In the front of the front section 17 there is a guiding portion 170. The receiving chamber 16, the front section 17 and the rear section 18 are coaxial along a same longitudinal axis. The rear section 18 still extends downwards through an undersurface 122 of the projection 120, creating two opposite lappets 1201 thereof. Inside the two lappets 1201, two blocks 1202 are respectively formed on the front portion of the inner surface of the two lappets 1201, defining a vertical receiving channel 121 therebehind. A rectangle recess 124 is defined under the projection 120, extending forward to communicate with the receiving chamber 16. A pair of rectangle apertures 125 are respectively defined at the two sides of the projection 120, communicating with the receiving hole too.

Rims 140 for blocking up the housing 10 are formed on the bottom face 14 adjacent the front face 11 and on the bottom face 14 adjacent the opposite side faces 15. A guiding prism 141 for guiding the power connector 1 into a print circuit board (not shown) projects vertically from the center of the bottom face 14.

Figure 6:
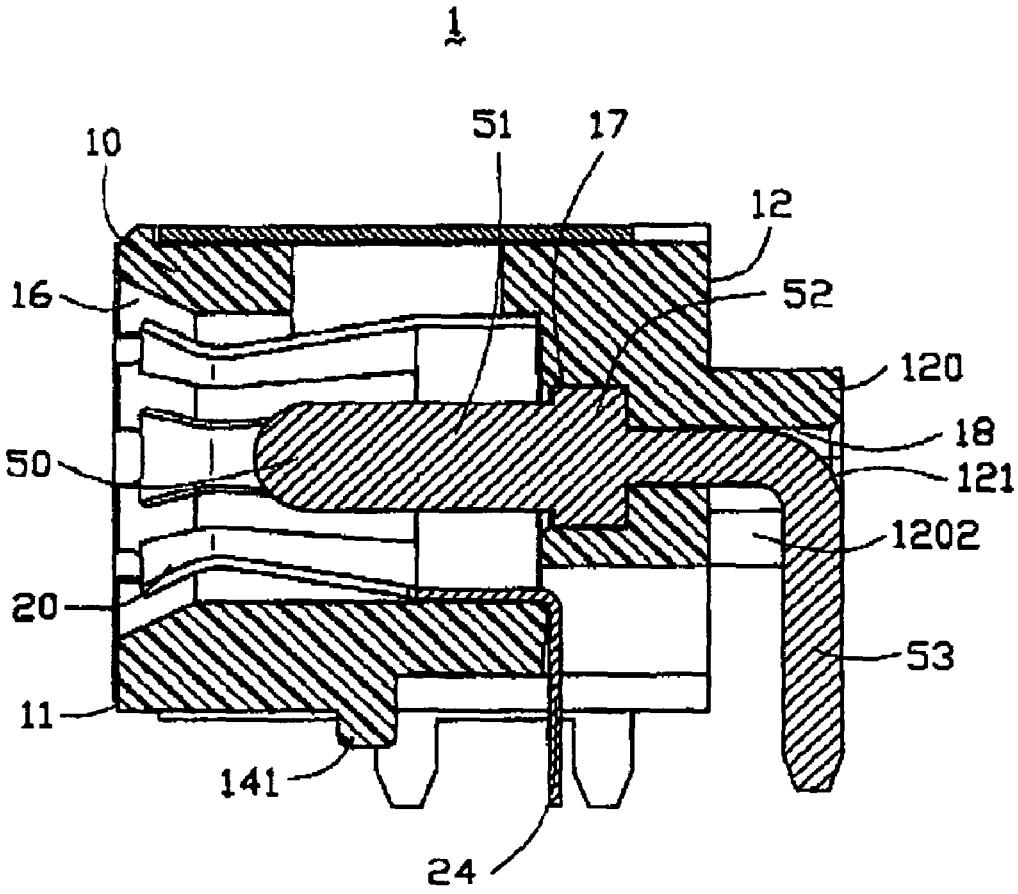
FIG. 6 is a cross-sectional view of the power connector taken along line 6—6 of FIG. 1.

Referring to FIG. 3, the first contact 20 is an annulation having six split lamellas (not labeled) and comprises a head portion 21 being in the shape of a bugle, a trail portion 22 integrating the six split lamellas (not labeled) into an annular unity, a pair of retaining portions 23 extending sideward from the trail portion 22, and a soldering portion 24 extending downwards from the trail portion 22. The end 211 of the head portion 21 functions as engaging portion of the fist contact 20. When the first contact 20 fixed into the housing 10, referring to FIGS. 1, 2 and 6, the head portion 21 is received in the guiding portion 160, and the retaining portions 23 are respectively inserted into the pair of rectangle apertures 125, then bent to sides to abut against the rear face 12, the soldering portion 24 is inserted into the rectangle recess 124, then bent down to project through the bottom face 14 of the housing 10 to be connected to the print circuit board.

Referring to FIG. 3, the second contact 50 is a single piece and comprises an engaging portion 51 for engaging with the complementary connector (not shown), a retaining portion 52 and a connecting portion 53 for connecting to print circuit board. The engaging portion 51, the retaining portion 52 and the connecting portion 53 are in a line and all in the shape of columns. A diameter of the retaining portion 52 is approximately equal to the diameter ($d_2$) of front section 17, and a diameter of the connecting portion 53 is approximately equal to the diameter ($d_1$) of the rear section 18. Referring to FIGS. 2, 3, 5 and 6 together, when the second contact 50 is inserted into the receiving chamber 16 through from the front face 11 of the housing 10, the connecting portion 53 protrudes out of the housing 10 throughout the front section 17 and the rear section 18 while the retaining portion 52 being blocked off before the rear section 18 because that the diameter ($d_2$) of the retaining portion 52 is larger than the diameter ($d_1$) of the rear section 18. Thus the second contact 50 is prevented from being pushed backwards while the complementary connector (not shown) being inserted into the housing 10. The connecting portion 53 is bent down after it's projected out of the housing 10 at the position where it just comes out of the housing 10, thus the bent portion is received in the vertical receiving channel 121 of the projection 120 and warded off behind the block 1202. So the second contact 50 is prevented from being pulled forwards together with the complementary connector (not shown) while the complementary connector being drawn out of the housing 10. And the two lappets 1201 lock the bent connecting portion 53 preventing the second contact 50 from revolving.

Referring to FIGS. 1 to 4, the front shield 40 is installed to the front face 11 of the housing 10. A hole 41 has a same diameter with and coaxial with the receiving chamber 16 is defined in the center of the front shield 40, and a plurality of resilient flakes 42 extending inwards are defined around the edge of the hole 41. A pair of wings 43 are formed at two opposite sides of the front shield 40. Slots 44 are defined on the front shield 40 corresponding to the protruding ridge 101 on the two side faces 15 of the housing 10. The engagement of the slots 44 and the protruding ridge couples 102 makes the front shield 40 be hold onto the housing 10.

The rear shield 30 is in the shape of "U", two notches 32 are defined on two side faces 31 of the rear shield 30 corresponding to the protuberances 150 on the side faces 15 of the housing 10. Positioning pieces 33 for positioning the rear shield 30 to the print circuit board are defined vertically extending from bottom of the two side faces 31 of the rear shield 30.

The disclosure is illustrative only, changes maybe made in detail, especially in matter of shape, size, and arrangement of parts within the principles of the invention. For example, it would be doable that directly form a vertical receiving portion 121 within the housing 10 extending vertically from where the rear section 18 reaches the rear face 12 without increasing a projection 120. And the second contact 50 would be hexagonal, but not limited to be annular.

What is claimed is:

1. A power connector comprising:

a housing defining a tube-like receiving chamber extending through a front face thereof and a receiving hole extending through a rear face thereof, the receiving hole comprising a front section and a rear section, the front section being communicating with the receiving chamber and being larger than the rear section in diameter thereof to form a step portion therebetween;

a first contact extending into the receiving chamber; and a second contact being a single piece and comprising an engaging portion extending in the receiving chamber, a retaining portion extending from the engaging portion and engaging with the step portion for preventing the second contact from moving rearwardly, and a connecting portion extending from the retaining portion and comprising a bent portion engaging with the rear face of the housing for preventing the second contact from moving forwards.

2. The power connector as described in claim 1, wherein the receiving chamber and the receiving hole are along a same longitudinal axis of an inner portion of the housing.

3. The power connector us described in claim 1, wherein the housing defines a vertical receiving channel in the rear face thereof to accommodate the bent portion of the connecting portion.

4. The power connector as described in claim 1, wherein the housing comprises rims formed on a bottom face thereof.

5. The power connector as described in claim 1, further comprising a front shield and a rear shield.

6. The power connector as described in claim 5, wherein the housing has protuberances formed on two side faces thereof, and wherein the rear shield has notches defined on side faces thereof for engaging with the protuberances.

7. The power connector as described in claim 6, wherein the housing has protruding ridges fanned on side faces, the front shield comprises a pair of wings respectively formed at two opposite sides thereof and defining slots corresponding to the protruding ridges.

8. The power connector as described in claim 7, wherein the housing has protruding portions formed at corners on a top face and side faces adjacent a rear face, and wherein an interval between the protruding ridges and side protruding portions is equal to a width of the rear shield for receiving the rear shield suitably.

9. The power connector as described in claim 8, wherein the rear shield comprises positioning pieces vertically extending downwards from bottom of the two side faces.

10. The power connector as described in claim 9, wherein the housing has a guiding prism vertically projecting from bottom face thereof.

11. The power connector as described in claim 1, wherein the first contact comprises a solder tail to be soldered to a printed circuit board.

12. The power connector as described in claim 1, wherein the first contact surrounds the second contact in the receiving chamber.

13. The power connector as described in claim 1, wherein the first contact and the engaging portion of the second contact define an annular sleeve for accommodating a mating portion of a complimentary connector.

14. A power connector comprising:

an insulative housing defining a front receiving chamber and a rear receiving hole communicating with each other;

an outer shell assembly enclosing the housing and defining a front opening with a plurality of inward tabs arranged along a periphery of said opening;

a first contact disposed in the receiving chamber and defining ring-like base with a plurality of spring arms extending forwardly from the base and respectively engaged with the corresponding tabs, and a tail section extending downwardly beyond the housing; and a second contact disposed in the receiving hole and defining a mating portion extending into the receiving chamber and surrounded by the first contact, and a tail portion extending out of the housing behind the tail section of the first contact.

15. A method of making a power connector comprising:

providing a one piece insulative housing with a front receiving chamber and a rear receiving hole communicating with each other along a front-to-back direction, said front receiving chamber directly communicating with an exterior through a front mating opening in a front face of the housing, said rear receiving hole is formed with a step therein;

inserting a first contact into the rear receiving hole through said front mating opening and said front receiving chamber until the first contact abutting against the step;

bending a tail portion of the first contact to hold the first contact in position without back and forth moving relative to the housing;

inserting a second contact into the front receiving chamber via said front mating opening wherein said first contact surrounds said second contact in said receiving chamber; and bending a tail section of the second contact to hold the second contact in position without back and forth moving relative to the housing.

* * * * *